United States Patent [19]

Hughes

[11] 4,269,412

[45] May 26, 1981

[54] GOLF CLUB GRIP

[75] Inventor: J. Walter Hughes, Houston, Tex.

[73] Assignee: Contour-Concept, Inc., Texarkana, Tex.

[21] Appl. No.: 949,943

[22] Filed: Oct. 10, 1978

[51] Int. Cl.[3] ..... A63B 53/14

[52] U.S. Cl. ..... 273/81.3

[58] Field of Search ..... 273/81.3, 81.4, 81 R

[56] References Cited

U.S. PATENT DOCUMENTS

| | | | |
|---|---|---|---|
| 1,201,728 | 10/1916 | Henry et al. | 273/81.3 |
| 1,561,349 | 11/1925 | Murphy et al. | 273/81.3* |
| 1,616,377 | 2/1927 | Knight | 273/81.3 |
| 1,979,174 | 10/1934 | Robertson | 273/81.3 |
| 2,212,651 | 8/1940 | Sanderson | 273/81.3 |
| 2,218,268 | 10/1940 | Reid | 273/81.3 |
| 3,332,684 | 7/1967 | Solheim | 273/81.3 |
| 3,782,725 | 1/1974 | Giambazi | 273/81.3 |

*Primary Examiner*—George J. Marlo
*Attorney, Agent, or Firm*—Finnegan, Henderson, Farabow, Garrett & Dunner

[57] ABSTRACT

A golf club grip having an outer contour shaped to permit a golfer's hands to assume a substantially normal position when addressing the ball and to promote the correct rotation of the golfer's left elbow. The grip fits over the distal end of a golf club shaft and includes lower and higher hand grip portions each of which has a longitudinal axis which is inclined to and intersects the longitudinal axis of the shaft at an acute angle. These three longitudinal axes are oriented to achieve the desired outer contour. The longitudinal axis of the lower hand grip portion is inclined upward and away from the target and the longitudinal axis of the upper hand grip portion is inclined downward and toward the target. By allowing natural hand placement and promoting proper left hand rotation, the grip lessens the tendency to slice or hook.

18 Claims, 13 Drawing Figures

Fig. 7
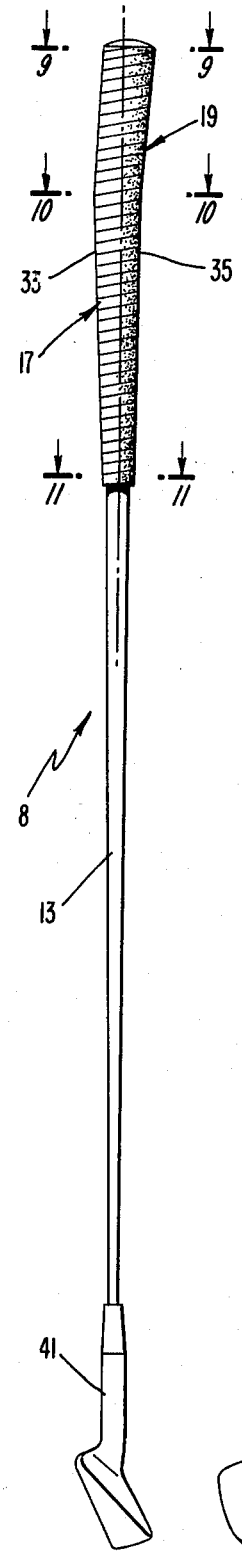
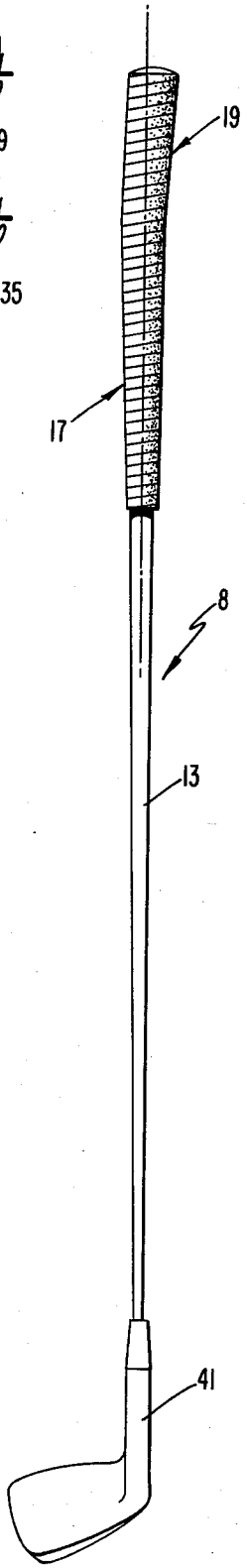
Fig. 8
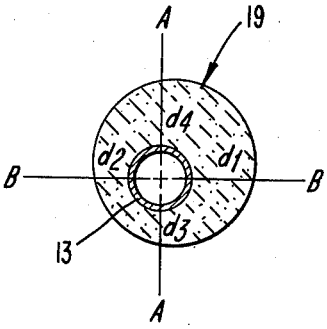
Fig. 9
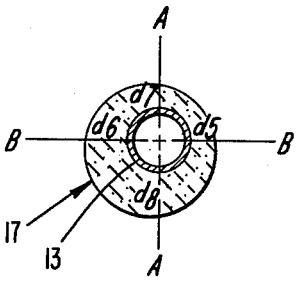
Fig. 10
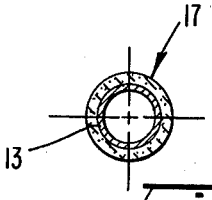
Fig. 11
Fig. 12
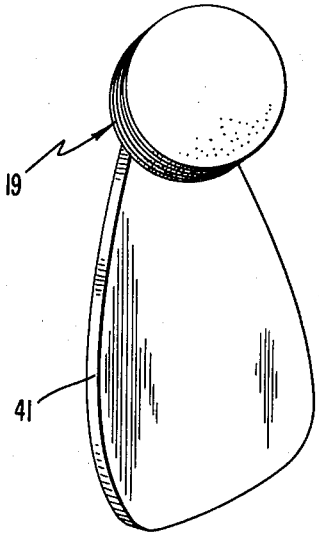
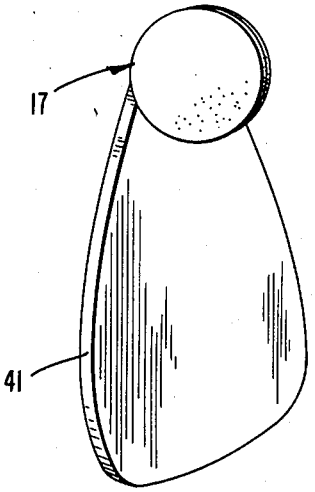
Fig. 13

GOLF CLUB GRIP

BACKGROUND OF THE INVENTION

1. Field of the Invention

The present invention relates generally to golf club grips and more specifically to a golf club grip having contours which are shaped to permit the golfer's hands to assume a substantially natural position when addressing the ball and to promote the correct rotation of the golfer's left elbow before and during the swing.

2. Description of the Prior Art

Several types and designs of golf club grips have been developed in the past. Some grips are comprised of a long strip of leather or similar material which is wrapped about the club shaft and adhered to the shaft with adhesive, end tacks or other similar means. Other golf grips are formed of a solid rubber or plastic body which fits over the shaft and is adhered to the shaft with double sided adhesive tape or an adhesive resin. The majority of these grips are either cylindrical or frustoconical in shape and have a single longitudinal axis which is coaxial with the axis of the shaft.

The problem presented by the conventional grip is that the contour of its outer surface is substantially symmetrical with the curved surface of the shaft. Such a contour does not conform to the natural position of a golfer's hands when gripping the club. The golfer must, therefore, grip the club in an unnatural manner which makes it difficult for the golfer to position his left elbow correctly. Furthermore, to grasp a conventional grip fully along the entire length of his palm, a right-handed golfer must rotate his right wrist clockwise to an abnormal position. Similarly, a right-handed golfer must rotate his left wrist counterclockwise to completely grasp the known grips. A left-handed golfer is faced with the same problems in reverse.

The conventional golf grips tend to promote, rather than lessen, slices and hooks. When a golfer utilizing the conventional grip swings to hit the ball, his hands often attempt to return to their more natural position. If the left hand is in the more natural position when a right-handed golfer strikes the ball, the golfer's hands will be forward of the club face and the face will be open, tending to push the ball right of the target, to cause a slice or both. In contrast, if a right-handed golfer's right hand is in its more natural position, the club face will be in front of the golfer's hands at the moment of impact and the face of the club will be closed, tending to pull the ball left of the target, to cause a hook, or both. Furthermore, a right-handed golfer using a conventional grip must rotate his left elbow during the backswing to develop a controlled, classical swing. If he fails to rotate his elbow properly, he will lose control and tend to hook or slice.

SUMMARY OF THE INVENTION

The object of the present invention is to provide a golf club grip which lessens a golfer's tendency to hook or slice by permitting the golfer's hands to assume a substantially natural position when addressing the ball and by promoting the correct elbow rotation. Another object is to provide an embodiment of the inventive grip which can fit upon a regulation, straight shaft of an ordinary golf club.

Additional objects and advantages of the invention will be set forth in part in the description which follows, and in part will be obvious from the description, or may be learned by practice of the invention. The objects and advantages may be realized and attained by means of the instrumentalities and combinations particularly pointed out in the appended claims.

To achieve the objects and in accordance with the purpose of the invention, as embodied and broadly described herein, the golf club grip of this invention comprises a lower hand grip portion having a longitudinal axis diverging outwardly at an acute angle away from the main line of the longitudinal axis of the club shaft as defined between the grip and the club head, a higher hand grip portion having one end integrally abutting one end of the lower hand grip portion and having an axis diverging outwardly at an acute angle away from the main line, the axis of the lower hand grip portion diverging on one side of a vertical reference plane passing through the main line and perpendicular to a lateral reference plane defined by the main line and an imaginary line between the club head end of the shaft axis and the intended target, and the axis of the higher hand grip portion diverging on the other side of the vertical reference plane and on the side of the lateral reference plane opposite the club head.

The grip of the present invention fits upon the distal end of a golf club shaft and may include a longitudinal hollow tube within the lower and higher hand grip portions. The hollow tube can be cylindrical and sized to accept a standard, straight shaft of a conventional, United States Golf Association (U.S.G.A.) approved club, or may be frustoconical to accept a shaft which tapers inwardly at its distal end. Furthermore, the principles of the invention may be used in combination with a bent shaft having axes which are coaxial with the longitudinal axes of the lower hand grip portion and the higher hand grip portion, respectively.

In the preferred embodiment, the grip includes a cylindrical hollow tube section designed to accept a straight shaft of a golf club. That embodiment is preferred since the U.S.G.A. rules presently only sanction the use of straight-shafted clubs.

The golf club grip of the invention overcomes the problems and disadvantages of prior, conventional golf club grips by providing contours which permit a golfer's hands to be in a substantially more natural position when addressing the ball. Additionally, the contours of the present invention promote the proper rotation of the left elbow before and during the swing of the club. The present invention, therefore, increases the golfer's control during his swing and lessens the golfer's tendency to push or pull the shot, or to hook or slice, due to improper hand positioning or left elbow rotation.

It is understood that both the foregoing general description and the following detailed description are exemplary and explanatory only and are not restrictive of the invention, as claimed.

The accompanying drawings, which are incorporated in and constitute a part of this specification, illustrate one embodiment of the invention and, together with the description, serve to explain the principles of the invention.

BRIEF DESCRIPTION OF THE DRAWINGS

FIG. 7 is a side view of the preferred embodiment of the golf club grip shown in FIGS. 3 and 4 with the toe of the golf club extending into the plane of the paper.

FIG. 8 is a side view of the preferred embodiment of the golf club grip rotated 90° with respect to FIG. 7.

FIG. 9 is a cross-sectional view of the preferred embodiment of the golf club grip and shaft taken along line 9—9 of FIG. 7.

FIG. 10 is a cross-sectional view of the preferred embodiment of the golf club grip and shaft taken along line 10—10 of FIG. 7.

FIG. 11 is a cross-sectional view of the preferred embodiment of the grip golf club and shaft taken along line 11—11 of FIG. 7.

FIG. 12 is a complete plan view of the grip and club showing the inclination of the higher hand grip portion of the grip.

FIG. 13 is a partial plan view taken from line 10—10 of FIG. 7 downward and showing the inclination of the lower hand grip portion of the grip.

DETAILED DESCRIPTION OF THE PREFERRED EMBODIMENTS

Figure 1:
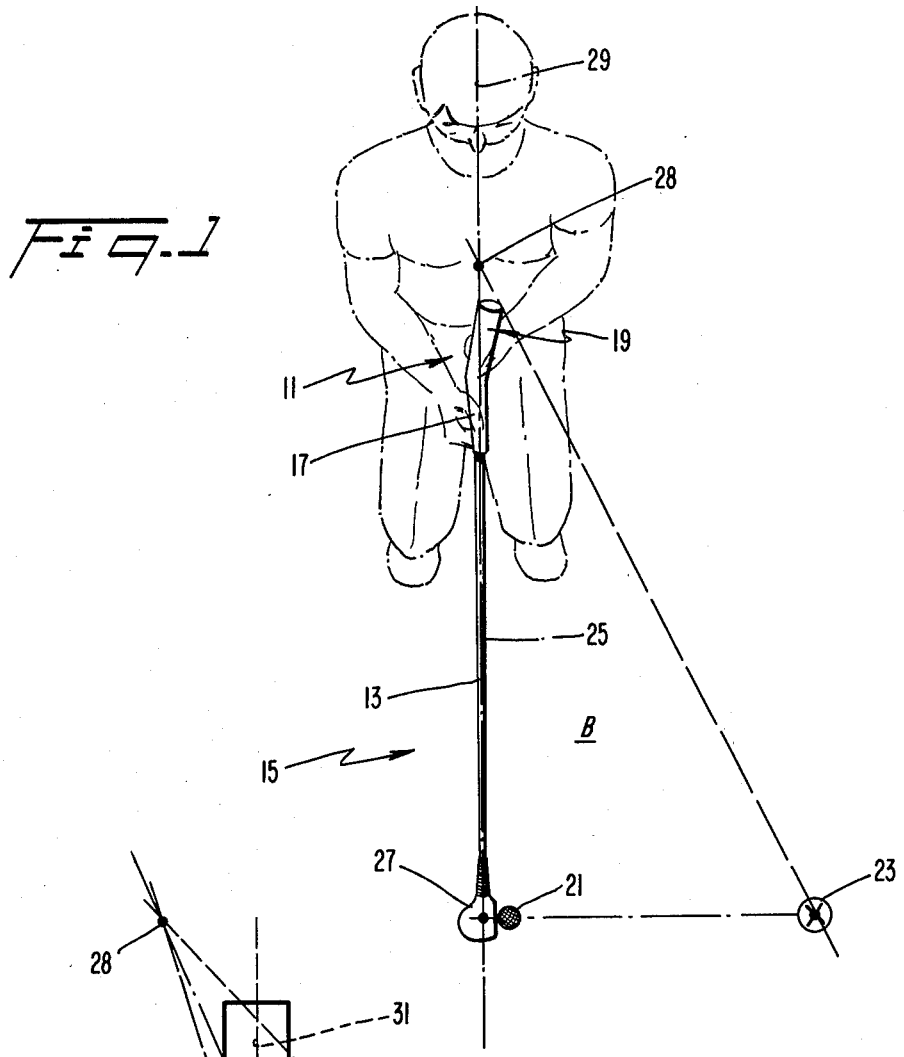
FIG. 1 is an exaggerated perspective view of the invention positioned on a golf club and held by a golfer.

As shown in FIG. 1, the golf club grip, represented generally by the numeral 11 fits over the distal end of a shaft 13 of a golf club represented generally by numeral 15. The grip 11 is comprised of a lower hand grip portion 17 and a higher hand grip portion 19 and is adhered to the shaft by common means such as adhesive or two-sided tape.

FIG. 1 shows diagramatically a right-handed golfer addressing a ball 21 and desiring to hit a straight shot toward a target point 23. A vertical reference plane passing through the main line 29 of the longitudinal axis 25 of the club shaft 13 bisects the shaft into right and left sections with respect to the golfer. Such a plane is represented by the letter A in FIG. 2.

A lateral reference plane B perpendicular to the vertical reference plane A, is defined by a point 27 at the club head end of the longitudinal axis 25 of the shaft 13, the target point 23 and any second point in the main line 29 of the longitudinal axis 25 of the shaft 13 such as a point 28 beyond the outer end of the shaft.

Figure 2:
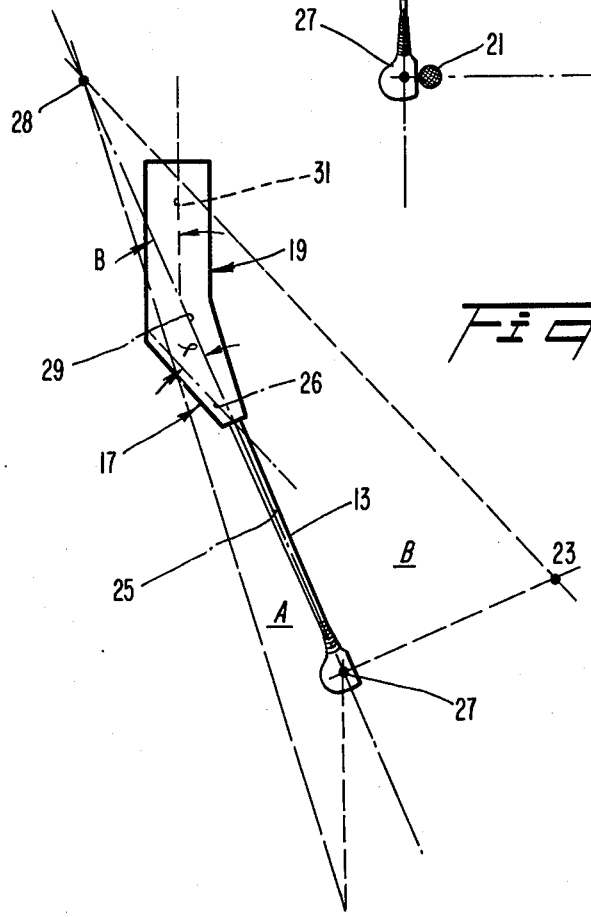
FIG. 2 is an exaggerated perspective view of the golf club and grip and shows the angular relationships of the axes of the club shaft, the lower hand grip portion and the higher hand grip portion.

FIG. 2 is an exaggerated perspective view of the preferred embodiment of the golf club grip and shows the angular relationships of the axes of the club shaft, the lower hand grip portion 17 and the higher hand grip portion 19 with respect to the vertical and lateral reference planes. Additionally, FIG. 2 shows the spacial relationship of these axes.

The axis 26 of the lower hand grip portion 17 intersects with the main line 29 of the longitudinal axis 25 of the club shaft 13, as defined between the grip and the club head, at an acute angle $\alpha$. Similarly, the axis 31 of the higher hand grip portion 19 intersects with the main line 29 at an acute angle $\beta$.

FIG. 2 shows the relationship of the axes and the vertical reference plane A and the lateral reference plane B. As shown, the main line 29 of the longitudinal axis 25 lies along the intersections of the reference planes. The axis 26 of the lower hand grip portion 17 diverges to the right side (with respect to the golfer) of the vertical reference plane A and to the upward side (away from the golfer) of the lateral reference plane B. The axis 31 of the higher hand grip portion 19 diverges to the left side of the vertical reference plane A and to the downward side of the lateral reference plane B.

Figure 3:
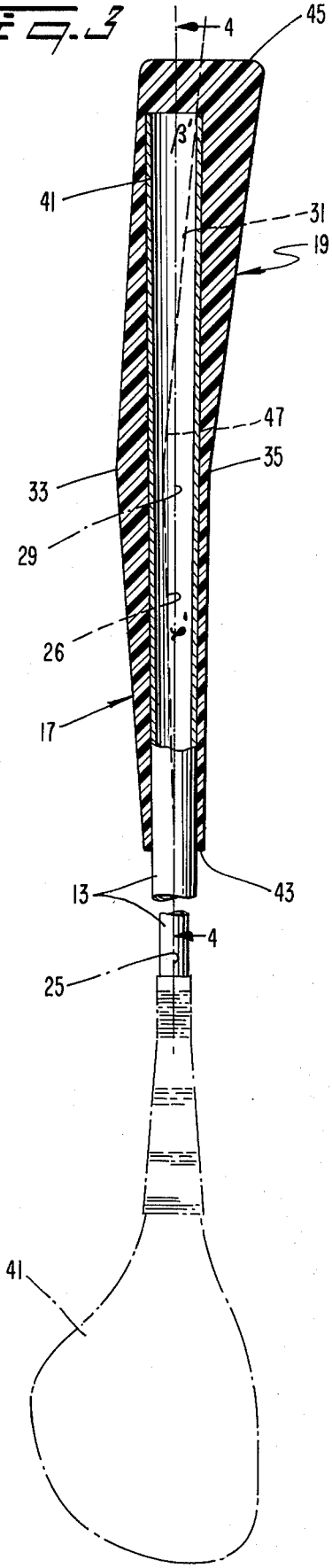
FIG. 3 is a top sectional view of one embodiment of the invention taken along a lateral plane defined by the extended longitudinal axis of the shaft and a line between the club head end of the shaft's axis and the intended target.

The preferred embodiment of the grip for a right-handed golfer is shown in detail in FIGS. 3 and 4 and FIGS. 7–13. FIG. 3 is a top sectional view of the grip taken along the lateral reference plane B and shows the right side 33 and left side 35 of the grip, with reference to the golfer as shown in FIG. 1. The axis 26 of the lower hand grip portion 17 intersects with the main line 29 of longitudinal axis 25 and diverges outwardly on one side of the vertical reference plane A as shown in FIG. 2. The axis 31 of the higher hand grip portion 19 intersects with the main line 29 and diverges outwardly on the opposite side of the vertical reference plane A from the axis 26 of the lower hand grip portion 17.

Figure 4:
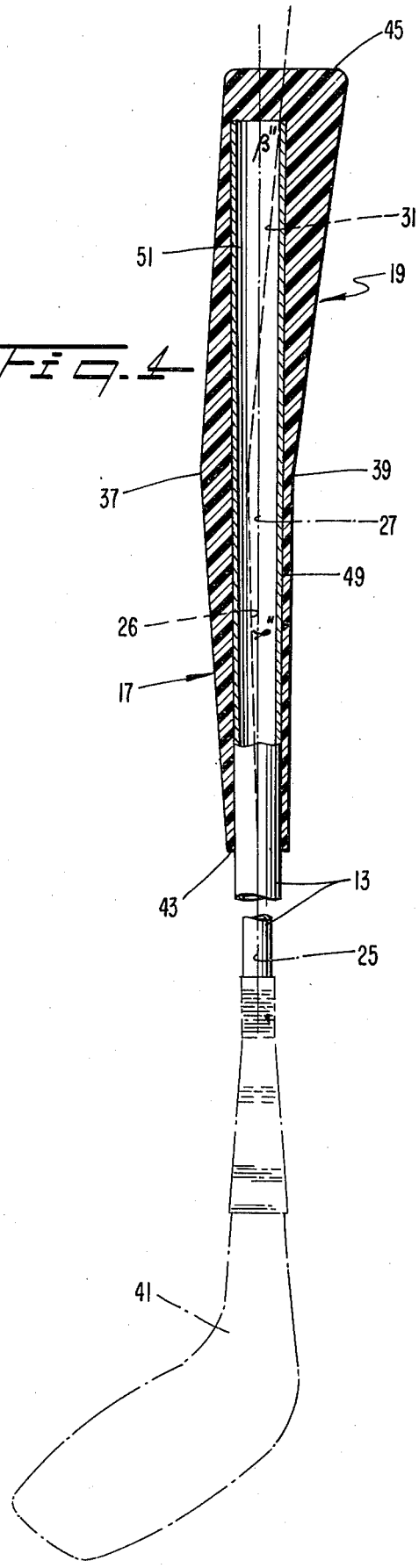
FIG. 4 is a side sectional view taken on line 4—4 of FIG. 3.

FIG. 4 represents substantially a vertical section taken along vertical reference plane B and shows the outline of the top 37 and bottom 39 contours of the grip. The axis 26 of the lower hand grip portion 17 intersects with the main line 29 and diverges outwardly on the same side of the lateral reference plane B as the club head 41. Axis 31 of the higher hand grip portion 19 intersects with the main line 29 and diverges outwardly on the side of the lateral reference plane opposite the club head 41.

In reference to the right-handed golfer shown in FIG. 1, the preferred embodiment of the grip, as shown in FIGS. 3 and 4, would be oriented in the following manner. The axis 26 of the lower hand grip portion would incline upwardly and rightwardly with respect to the main line 29 of the longitudinal axis 25 of the shaft 13. The axis 31 of the higher hand grip portion would incline downwardly and leftwardly with respect to the main line 29.

As shown in FIGS. 3 and 4, the lower hand grip portion 17 and the higher hand grip portion 19 are substantially frustoconical in shape and have circumferences which increase from the lowermost end 43 of lower hand grip portion 17 to the uppermost end 45 of higher hand grip portion 19. The axes of the lower hand grip portion 17 and the higher hand grip portion 19 are co-terminous at the point 47 where the portions abut, and the grip portions include within themselves a hollow cylindrical tube 49 for accepting the distal end 51 of a straight shaft 13 having a diameter substantially the same as the cylindrical tube 49. Since U.S.G.A. rules require that the shaft of a golf club be straight, the preferred embodiment of the grip complies with those rules.

The angles of intersection $\alpha$ and $\beta$ shown in FIG. 2 may vary over a considerable range and still serve the objectives of the invention. The maximum and minimum achievable or desired angles depend upon factors including a particular golfer's physical characteristics, the length and width of the golf grip and the length, size and shape of the distal end of the golf club shaft lying within the grip. It has been found that the acute angles $\alpha$ and $\beta$ may vary from about 1° to 9°. The angles $\alpha$ and $\beta$ for a given embodiment of the grip may be the same or different depending upon the size and shape of the grip and shaft and the physical characteristics of a golfer for whom the grip is designed. In the preferred embodiment utilizing the cylindrical tube 49 it has been found that, for the average physical characteristics, the angle $\alpha$ is not more than 4° and the angle $\beta$ is not more than 7°.

FIG. 3 shows the angles $\alpha'$ and $\beta'$ which represent the respective projections of angles $\alpha$ and $\beta$ upon the lateral reference plane. Similarly, FIG. 4 shows the angles $\alpha''$ and $\beta''$ which represent the respective projections of angles $\alpha$ and $\beta$ upon the vertical reference plane. In the preferred embodiment of the invention, the angles $\alpha'$ and $\alpha''$ are the same, and the angles $\beta'$ and $\beta''$ are the same. This preferred configuration simplifies the design of the grip and standardizes its manufacture.

The inclination of the lower hand grip portion 17 both to the right and upwardly is preferred. This upward and rightward inclination permits a right-handed golfer to place his right hand in a more natural position. Since the golfer's right hand is in its natural position, there is less tendency for the golfer to hit the ball with the club face closed, causing a pulled shot, or hook, or both.

The inclination of the higher hand grip portion 19 both to the left and downwardly is necessary to fulfill the objective of the invention and serves a two-fold purpose. First, the inclination to the left permits a right-handed golfer to place his left hand in a more natural position. Second, the left and downward inclination promotes the correct rotation of the golfer's left elbow when he grasps the grip. When a right-handed golfer places his left hand on the higher hand grip portion 19, he must rotate his hand and elbow into the proper position.

As a result of the dual inclination of the higher hand grip portion, the golfer has less of a tendency to hit the ball with the club face open, causing a pushed shot, a slice, or both. Also, his left elbow is properly positioned before he begins the backswing, giving him additional control.

FIGS. 7–12 further illustrate the preferred embodiment of the grip illustrated in FIGS. 3 and 4. As shown in FIG. 7, the higher hand grip portion 19 of the grip is inclined toward the target and the lower hand grip portion 17 is inclined away from the target. As shown in FIG. 8, the upper hand grip portion 19 is inclined downwardly toward the golfer and the lower hand grip portion is inclined upwardly.

As shown in FIGS. 3 and 4, in the preferred embodiment of the invention, the grip has a single hollow tube which is formed to fit over the distal end of a straight shaft. Since the longitudinal axes of the upper hand grip portion and the lower hand grip portion intersect with the longitudinal axis of the straight shaft at acute angles, the grip at certain cross-sections is necessarily eccentric with respect to the shaft axis. This relationship is shown in FIGS. 9–11.

As shown in FIG. 9, the wall thickness of the grip taken at cross-section 9—9 differ with respect to one another. Along the lateral plane B, the wall thickness $d_1$ of the grip toward the target is thicker than the wall thickness $d_2$ of the grip. Similarly, at cross-section 9—9, the wall thickness $d_4$ nearer the golfer is thicker than the wall thickness $d_3$.

At the cross-section 10—10, taken at the upper extremity of the lower hand portion, the relationship of the respective walls is reversed. Along the lateral plane B, the wall thickness $d_6$ opposite the target is greater than the wall thickness $d_5$, and along the vertical plane A, the wall thickness $d_8$ is greater than the wall thickness $d_7$.

As illustrated in FIG. 13, the grip and shaft are concentric at the end of the grip closest to the club head.

The inclination of the upper hand grip portion and the lower hand grip portion is further illustrated in FIGS. 12 and 13. FIG. 12 is a plan view of the entire grip and shows that the higher hand grip portion inclines toward the target and downward toward the golfer. FIG. 13, representing a partial plan view from lines 10—10 of FIG. 7 downward, shows that the lower hand grip portion inclines away from the target and upward away from the golfer.

While FIGS. 3, 4 and 7–13 show the preferred embodiment of the invention, the invention itself is not limited to that particular configuration. Several modifications of the invention are equally effective to reduce slices and hooks.

Figure 5:
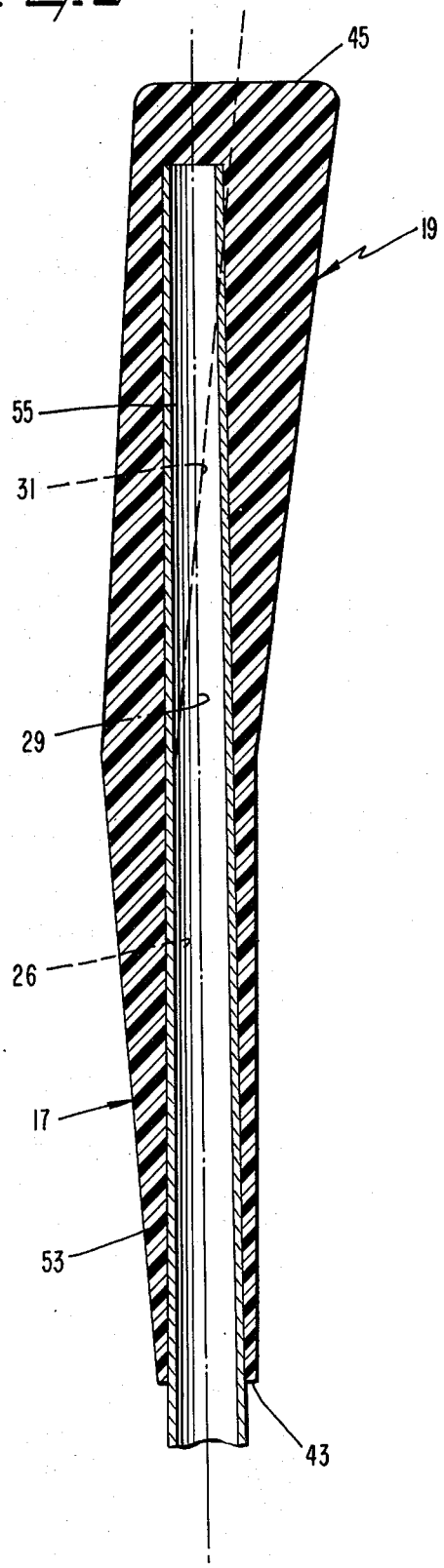
FIG. 5 is a top sectional view of a second embodiment of the invention taken along the same plane as in FIG. 3.

FIG. 5 is a top sectional view of a second embodiment of the invention taken along the lateral reference plane B and shows the right and left contours of the grip. In that embodiment, the hollow tube 53 within the lower and higher hand grip portions is frustoconical in shape. The shaft extending within the hollow tube is similarly tapered. This tapering of the shaft and tube permits the design of a grip having greater angles $\alpha$ and $\beta$ for a golf grip of a given length and width.

Figure 6:
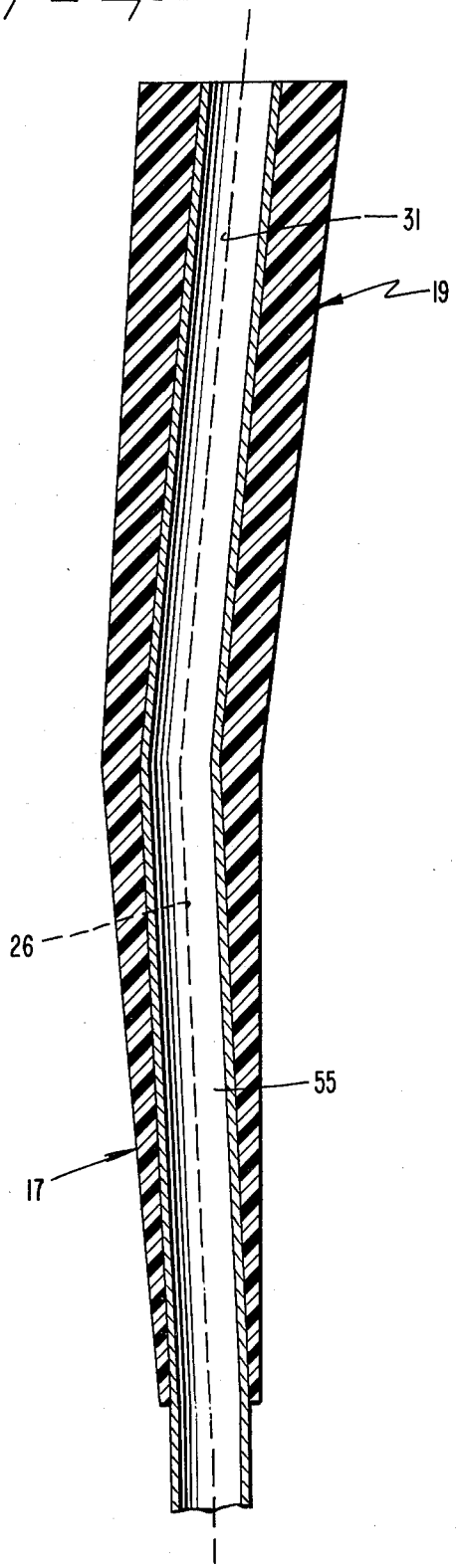
FIG. 6 is a top sectional view of a third embodiment of the invention taken along the same plane as in FIG. 3.

FIG. 6 shows another embodiment of the invention in a top sectional view taken along the lateral reference plane B. In FIG. 6, the shaft 55 is bent so that the axis of the shaft within said lower grip portion 17 is coaxial with that portion's longitudinal axis 26 and the axis of the shaft within said higher hand grip portion 19 is coaxial with the longitudinal axis 31 of that portion.

Obviously, many modifications and variations of the present invention are possible in light of the above teachings. For example, although the drawings and descriptions have been drawn to a grip for a right-handed golfer, the grip and its concept is applicable to a left-handed golfer also. Thus, it is intended that the present invention cover the modifications and variations of the invention provided they come within the scope of the appended claims and their equivalents.

What is claimed is:

1. A grip for a golf club for fitting over the shaft of a golf club and for reducing hooks and slices in hitting a ball toward an intended target comprising:

a lower hand grip portion having a longitudinal axis diverging outwardly at an acute angle away from the main line of the longitudinal axis of the club shaft as defined between the grip and the club head;

a higher hand grip portion having one end integrally abutting one end of said lower hand grip portion and having an axis diverging outwardly at an acute angle away from said line, a hollow longitudinal tube formed within the lower and upper hand grip portions for accepting the distal end of the shaft of the golf club, said axis of said lower hand grip portion diverging opposite the target side of a vertical reference plane passing through said main line and perpendicular to a lateral reference plane defined by said main line and an imaginary line between the club head end of the shaft axis and the intended target, and said axis of said higher hand grip portion diverging on the target side of said vertical reference plane and on the side of said lateral reference plane opposite the club head.

2. The grip of claim 1 wherein the acute angle of intersection between said longitudinal axis of said lower hand grip portion and the main line is in the range of 1° to 9°.

3. The grip of claim 2 wherein the acute angle of intersection between said longitudinal axis of said higher hand grip portion and said main line is in the range of 1° to 9°.

4. The grip of claim 1 wherein any cross-section of said lower hand grip portion and said higher hand grip portion, taken perpendicular to said main line, is substantially circular.

5. The grip of claim 4 wherein the lower hand grip portion and the higher hand grip portion are both frustoconical in shape, and the circumference of the lowest end of the lower hand grip portion is smaller than the circumference of the highest end of the higher hand grip portion.

6. The grip of claim 1 wherein said lower hand grip portion and said higher hand grip portion are concentric at the point where the two hand grip portions abut.

7. The grip of claim 1 wherein said longitudinal hollow tube is a cylindrical.

8. The grip of claim 7 further comprising a shaft extending within said longitudinal hollow, cylindrical tube, said shaft having substantially the same diameter as said longitudinal hollow, cylindrical tube.

9. The grip of claim 1 wherein said longitudinal hollow tube is frustoconical.

10. The grip of claim 9 further comprising a shaft extending within said longitudinal hollow, frustoconical tube, said shaft having at its distal end a frustoconical portion of substantially the same shape as said longitudinal hollow, frustoconical tube.

11. The grip of claim 1 wherein said longitudinal hollow tube is comprised of a first hollow tube portion within and concentric with said lower hand grip portion and a second hollow portion within said concentric with said higher hand grip portion and further comprising a shaft extending within said longitudinal tube, wherein the axis of said shaft within said lower grip portion is coaxial with the longitudinal axis of said lower grip portion, the axis of said shaft within said higher grip portion is coaxial with the longitudinal axis of said higher grip portion and the longitudinal hollow tube conforms to the shape of said shaft.

12. The grip of claim 1 wherein the axis of said lower hand grip portion diverges on the side of the lateral reference plane toward the club head.

13. A golf club grip for fitting over the straight shaft of a conventional golf club and for reducing hooks and slices in hitting a ball toward an intended target comprising:

a lower hand grip portion, a higher hand grip portion having one end integrally abutting one end of said lower hand grip portion, a longitudinal hollow tube, formed within said lower and higher hand grip portions, for accepting the distal end of the straight shaft of the golf club, said lower hand grip portion having a longitudinal axis intersecting with the axis of the straight club shaft at an acute angle and diverging both upwardly and away from the target, and said higher hand grip portion having a longitudinal axis intersecting with the axis of said straight club shaft at an acute angle and diverging both downwardly and toward the target.

14. The grip of claim 13 wherein any cross-section of said lower hand grip portion and said higher hand grip portion, taken perpendicular to the longitudinal axis of said shaft, is substantially circular.

15. The grip of claim 14 wherein the lower hand grip portion and the higher hand grip portion are both frustoconical in shape, and the circumference of the lowest end of the lower hand grip portion is smaller than the circumference of the highest end of the higher hand grip portion.

16. The grip of claim 15 wherein the lower hand grip portion and the higher hand grip portion are concentric at the point wherein the two hand grip portions abut.

17. The hand grip of claim 16 wherein the longitudinal hollow tube is cylindrical.

18. A golf club grip for fitting over the straight shaft of a conventional golf club and for reducing hooks and slices in hitting a ball toward an intended target comprising:

a frustoconical lower hand grip portion, a frustoconical higher hand grip portion having one end integrally abutting one end of said lower hand grip portion, the lower hand grip portion and the higher hand grip portion being concentrically at the point of abutment, a longitudinal hollow tube, formed within said lower and higher hand grip portions, for accepting the distal end of the straight shaft of the golf club, said lower hand grip portion having a longitudinal axis intersecting with the axis of the straight club shaft at an acute angle and diverging both upwardly and away from the target, and said higher hand grip portion having a longitudinal axis intersecting with the axis of said straight club shaft at an acute angle and diverging both downwardly and toward the target.

* * * * *

UNITED STATES PATENT AND TRADEMARK OFFICE

CERTIFICATE OF CORRECTION

PATENT NO. : 4,269,412

DATED : May 26, 1981

INVENTOR(S) : Hughes, J. Walter

It is certified that error appears in the above-identified patent and that said Letters Patent are hereby corrected as shown below:

Claim 11, col. 7, line 44, change "said" to --and--.

Claim 18, col. 8, line 42, change "concentrically" to --concentric--.

Signed and Sealed this

*Eighteenth* Day of *August 1981*

[SEAL]

*Attest:*

GERALD J. MOSSINGHOFF

*Attesting Officer*

*Commissioner of Patents and Trademarks*